US012208823B2

(12) United States Patent
Kumar et al.

(10) Patent No.: US 12,208,823 B2
(45) Date of Patent: Jan. 28, 2025

(54) VEHICLE SYSTEM AND METHOD

(71) Applicant: Transportation IP Holdings, LLC, Norwalk, CT (US)

(72) Inventors: Ajith Kuttannair Kumar, Erie, PA (US); Ronald B. Koerber, Lake City, PA (US); Todd C. Cronin, Fairview, PA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 858 days.

(21) Appl. No.: 17/345,818

(22) Filed: Jun. 11, 2021

(65) Prior Publication Data

US 2022/0396295 A1 Dec. 15, 2022

(51) Int. Cl.
*B61C 3/00* (2006.01)

(52) U.S. Cl.
CPC ..... *B61C 3/00* (2013.01)

(58) Field of Classification Search
CPC .... B61C 3/00; B61C 3/02; B61C 7/00; B61C 7/02; B61C 7/04
See application file for complete search history.

(56) References Cited

U.S. PATENT DOCUMENTS

| | | | |
|---|---|---|---|
| 7,309,929 | B2 | 12/2007 | Donnelly et al. |
| 7,430,967 | B2 | 10/2008 | Kumar |
| 8,117,969 | B1 | 2/2012 | Miller et al. |
| 8,408,144 | B2 | 4/2013 | Read |
| 9,200,554 | B2 | 12/2015 | Cook |
| 2018/0058296 | A1* | 3/2018 | Norton ..... F02D 41/005 |

* cited by examiner

*Primary Examiner* — Robert J McCarry, Jr.
(74) *Attorney, Agent, or Firm* — K&L Gates LLP

(57) ABSTRACT

A vehicle system includes an electric motor and one or more of a generator or an alternator coupled with the electric motor and configured to generate electric energy from rotation created by the electric motor. The generator or alternator is configured to power one or more traction motors to propel the vehicle system. The electric motor may replace a fuel engine of the vehicle system.

21 Claims, 4 Drawing Sheets

VEHICLE SYSTEM AND METHOD

BACKGROUND

Technical Field

The subject matter described herein relates to a vehicle system having an electric drive system and related method.

Discussion of Art

Certain existing vehicles may include engines that provide power to varying systems of the vehicle to power and/or propel the vehicle. The engine powered vehicles generate emissions with the consumption of fuel, e.g., diesel fuel. Engine emissions may be regulated by the government, such that it may be desirable or necessary to reduce or eliminate emissions. Converting the engine powered vehicle to a non-engine powered vehicle may reduce an amount of emissions generated by the vehicle. However, converting the engine powered vehicles to operate using alternative power solutions can require significant modifications to the vehicle. For example, converting a diesel powered vehicle to a non-diesel powered vehicle (e.g., an electric vehicle) may require the replacement of several existing components of the vehicle.

BRIEF DESCRIPTION

In one or more embodiments, a vehicle system includes an electric motor and one or more of a generator or an alternator coupled with the electric motor and configured to generate electric energy from rotation created by the electric motor. The generator or alternator is configured to power one or more traction motors to propel the vehicle system.

In one or more embodiments, a method includes removing an engine from a vehicle system that is coupled with one or more of a generator or an alternator for powering one or more traction motors to propel the vehicle system. An electric motor is coupled with the one or more of the generator or the alternator to generate electric energy and power the one or more traction motors to propel the vehicle system.

In one or more embodiments, a vehicle system includes an electric motor, one or more of a propulsion generator or a propulsion alternator coupled with the electric motor and configured to generate first electric energy from rotation of the electric motor. The one or more of the propulsion generator or the propulsion alternator is configured to power one or more traction motors. The vehicle system includes one or more an auxiliary generator or an auxiliary alternator coupled with the electric motor and configured to generate second electric energy from rotation of the electric motor to power one or more auxiliary loads of the vehicle system.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
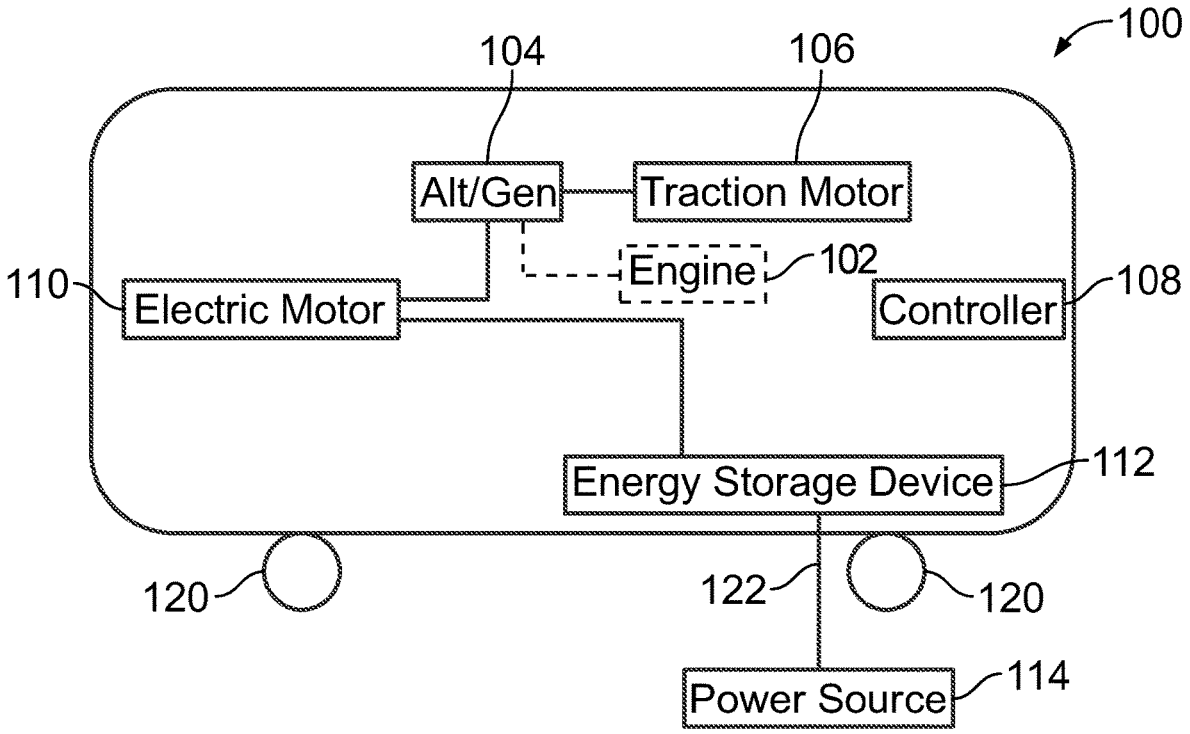
FIG. 1 illustrates a vehicle system in accordance with one embodiment.

Embodiments of the subject matter described herein relate to a vehicle system and method of operation. The vehicle system may include an electric motor that is powered to run propulsion and non-propulsion loads of the vehicle system. For example, the electric motor may run one or both of an alternator and/or generator device that may power traction motors of the vehicle system to propel the vehicle system. The electric motor may replace an engine of the vehicle system that was removed from the vehicle system along with engine-related components like an engine cooling system and fuel tank. For example, the electric motor may be retrofitted onto the vehicle system, and may be coupled with the alternator and/or generator device, or one or more other systems or devices of the vehicle system. In one or more embodiments, the electric motor may use the same, substantially the same, or a portion of the same connection system (e.g., mechanical, electrical, or the like) that connected the engine with the alternator and/or generator. For example, a portion of the connection system (e.g., mechanical, electrical, or the like) may be used to couple the engine with the alternator and/or generator, and used to couple the electric motor with the alternator and/or generator.

In one aspect, the electric motor may be powered by an on-board energy storage device, and operated at the same or similar speed (e.g., RPM) as the engine, thereby enabling use of the same propulsion components (e.g., alternator/generator, power electronics, traction motors, or the like) as previously, and obviating the need to provide new or different propulsion components. Thereby, an existing vehicle can be retrofitted for battery-electric operation, e.g., for eliminating engines emissions, by replacing the engine and engine components with the electric motor and energy storage device, at a relatively lower cost.

In one embodiment, the electric motor may provide electric power to the alternator and/or generator with rotation of a shaft of the electric motor. The alternator and/or generator may use the electric power from the electric motor to generate electric energy to power one or more traction motors to propel the vehicle system. Optionally, the electric motor may provide electric power to one or more different systems or devices of the vehicle system. For example, the electric motor may provide electric power to the alternator and/or generator to generate power for the traction motors (e.g., propulsion loads of the vehicle system), and the electric motor may be coupled with and provide electric power to an alternative system (e.g., one or more of an auxiliary alternator and/or auxiliary generator) to power non-propulsion loads of the vehicle system.

Optionally, the vehicle system may include plural electric motors operably coupled with one or more different systems and/or devices of the vehicle system. For example, one electric motor may be used to power propulsion loads of the vehicle system, and another electric motor may be used to power non-propulsion loads of the vehicle system. Optionally, a third electric motor may be used to power one or more other components or systems, such as a compressor of a brake system of the vehicle system. In one or more embodiments, a controller of the vehicle system may automatically control operation of each of the plural electric motors. For example, the controller may control one electric motor to operate at a first speed, and control another electric motor to concurrently operate at a second speed.

In one or more embodiments, the electric motor may receive electric energy from an onboard energy source, such as a fuel cell, energy storage device, or the like. Optionally, the electric motor may directly or indirectly receive electric energy from an off-board source. In one embodiment, an energy storage device onboard the vehicle system may be conductively coupled with an off-board power source (e.g., a charging station, or the like). Optionally, the off-board power source may be a catenary line or electrified rail that may be conductively coupled with one or both of the electric motor or the energy storage device onboard the vehicle system.

FIG. 1 illustrates one example of a vehicle system 100 in accordance with one embodiment. The vehicle system may a propulsion-generating vehicle such as, but not limited to, a locomotive or other rail vehicle, a switcher vehicle, an automobile, a truck, a bus, a mining vehicle, a marine vessel, an aircraft (manned or unmanned, such as a drone), an agricultural vehicle, or another off-highway vehicle. In the illustrated embodiment, the vehicle system includes plural wheels 120 in contact with a route along which the vehicle system moves. Optionally, the vehicle system may be a marine vessel or aircraft and may be devoid of wheels. For example, the vehicle system may move along a waterway, in a flight path, or the like. In one or more embodiments, the vehicle system may include two or more vehicles that may travel together (by being mechanically coupled or by being mechanically separate but logically coupled and communicating with each other to travel together, such as in a convoy or a locomotive consist where multiple locomotives communicate and operate together as a train). At least one vehicle of the vehicle system may be a propulsion-generating vehicle, and optionally the vehicle system may include one or more non-propulsion generating vehicles.

The vehicle system includes an engine 102 that is operably coupled with one or more of an alternator and/or generator device 104 (illustrated as "Alt/Gen"). For example, the engine may provide power to the alternator and/or generator device to power one or more traction motors 106 of the vehicle system. For example, power from the engine may be used to propel the vehicle system to move along a route. In one or more embodiments, the engine may be an internal combustion engine such as a diesel or other gasoline fueled engine. Optionally, the vehicle system may include an alternative mechanical drive system that is operably coupled with the engine. The drive system may include one or more of gears, belts, hydraulics, or the like, to control the propulsion of the vehicle system to move along the route with power from the engine.

In one or more embodiments, the vehicle system may additionally or alternatively be an electric powered vehicle system. For example, the vehicle system may include an electric motor 110 operably coupled with the alternator or generator device. In one embodiment, the electric motor may be coupled with an alternator device. In another embodiment, the electric motor may be operably coupled with a generator device. In another embodiment, the electric motor may be operably coupled with an alternator device and operably coupled with a generator device. In another embodiment, the electric motor may be operably coupled with a hybrid alternator/generator device that may operate as an alternative in a first mode of operation, and may operate as a generator in a second mode of operation.

In one embodiment, the engine may be removed, eliminated, or separated from the vehicle system, and the electric motor may be retrofitted within the vehicle system. For example, the electric motor may replace the engine. In one or more embodiments, the vehicle system may first operate with power generated by the engine (e.g., during a first period of time), and may subsequently operate with power from an electric motor after the engine is removed from the vehicle system (and/or disconnected from the traction motors) and the electric motor is operably coupled with the vehicle system. In another embodiment, the vehicle system may be referred to as a hybrid vehicle that includes the engine and the electric motor. For example, the engine may provide power to the alternator and/or generator device during a first operating mode of the vehicle system, and the electric motor may provide power to the alternator and/or generator device during a different, second operating mode of the vehicle system (e.g., the engine may be disconnected from the alternator and/or generator but remain onboard the vehicle system). In one or more embodiments, a controller 108 of the vehicle system may control which of the engine or the electric motor powers the vehicle system based on one or more conditions and/or characteristics of the vehicle system.

The controller may represent a control module, and can include one or more processors, microcontrollers, or other logic-based devices and/or associated software or instructions, for carrying out one or more operations described herein. The controller controls operations of the vehicle system, such as by controlling tractive efforts provided by the one or more tractive motors. The controller may be manually operated by receiving instruction signals from an input device (not shown) via an operator of the vehicle system (e.g., disposed onboard and/or off-board the vehicle system). Optionally, the controller may be automatically operated to autonomously control operations of the vehicle system. In one or more embodiments, the controller may receive signals (e.g., manually from an operator onboard the vehicle system, wirelessly from an off-board database, from a back-office server or dispatch center, or the like). The signals may represent instructions for how the controller is to control operation of the engine (e.g., speed, set point, fueling rate, or the like). The controller may interpret the received signals representing instructions for how to control operation of the engine, and use the interpreted signals to control operation of the electric motor.

The electric motor of the vehicle system is operably coupled with the alternator and/or generator device. For example, the electric motor may be operably coupled with the alternative and/or generator device via one or more belts or gears. In one or more embodiments, the belts or gears used to couple the electric motor with the alternator and/or generator device may be the same belts or gears used to couple the engine with the alternator and/or generator device. For example, the engine may be removed from the vehicle system, and the electric motor may replace the engine to provide power to the vehicle system. The belts or gears that coupled the engine with the alternator and/or generator device may also be used to couple the electric motor with the alternator and/or generator device. Optionally, additional engine related components (e.g., an engine cooling system, engine exhaust system, or the like) may be removed from the vehicle system in addition to the removal of the engine.

The electric motor may power rotation or movement of the belts and/or gears coupling the electric motor with the alternator and/or generator device. For example, rotation of the belts or gears created by the electric motor may be used to generate electric energy by the alternator and/or generator device, which may be used to power the one or more traction motors to propel the vehicle system. For example, an input of electric energy to the electric motor may be different than an energy output of the electric motor, and different than an energy output of the one or more of the alternator and/or generator. In one embodiment, the vehicle system may include one traction motor to propel the vehicle. Optionally, the vehicle system may include plural traction motors. Optionally, each of the plural traction motors may be operably coupled with to control the rotation of different axles of the vehicle system. For example, a first traction motor may be operably coupled with a first axle of the vehicle system, and a second traction motor may be operably coupled with a second axle of the vehicle system.

In one or more embodiments, the vehicle system may include an energy storage device 112 that may be used to store electric energy. The energy management system may be conductively coupled with the electric motor to supply the electric energy to the electric motor to power the electric motor. For example, the energy storage device may be a battery or alternative electric energy storage device onboard the vehicle system. The energy storage device may direct electric energy to the electric motor responsive on command, such as by the controller or an operator onboard the vehicle system. Optionally, the energy storage device may continuously and/or intermittently supply electric energy to the electric motor.

In one or more embodiments, the energy storage device may be conductively coupled with a power source 114 disposed off-board the vehicle system via one or more conductors 122. The off-board power source may supply electric energy to the energy storage device. For example, the energy storage device may be able to contain or withhold a predetermined amount of electric energy used to power one or more systems onboard the vehicle system (e.g., auxiliary systems, to power the electric motor, or the like). The amount of electric energy available within the energy storage device may be reduced based on an amount of electric energy used by the vehicle system. The off-board power source may provide an amount of electric energy to the energy storage device to account for the amount of energy used by the vehicle system. Optionally, the off-board power source may directly provide electric energy to the electric motor or one or more other systems of the vehicle system. For example, the vehicle system may be devoid an energy storage device, and the off-board power source may be the source of electric energy to the electric motor.

In one embodiment, the energy storage device may be coupled with the off-board power source while the vehicle is stationary. For example, the power source may be a charging station or the like, that may be conductively or wirelessly coupled with the energy storage device to provide electric energy to the energy storage device (e.g., to recharge the energy storage device). Alternatively, the energy storage device may be coupled with the off-board power source while the vehicle system is moving. For example, the power source may be a catenary line, an electrified rail, or the like, that may be conductively coupled with the vehicle system while the vehicle system moves along a route.

In the illustrated embodiment, the vehicle system includes singular components disposed onboard a single vehicle of the vehicle system. Optionally, the vehicle system may include any number of the components shown, and the multiple components may be disposed onboard different vehicles of a multi-vehicle system. For example, the vehicle system may include plural propulsion-generating vehicles, and the alternator and/or generator device onboard one propulsion-generating vehicle may be used to power traction motors disposed on each of the different plural propulsion-generating vehicles.

Figure 2:
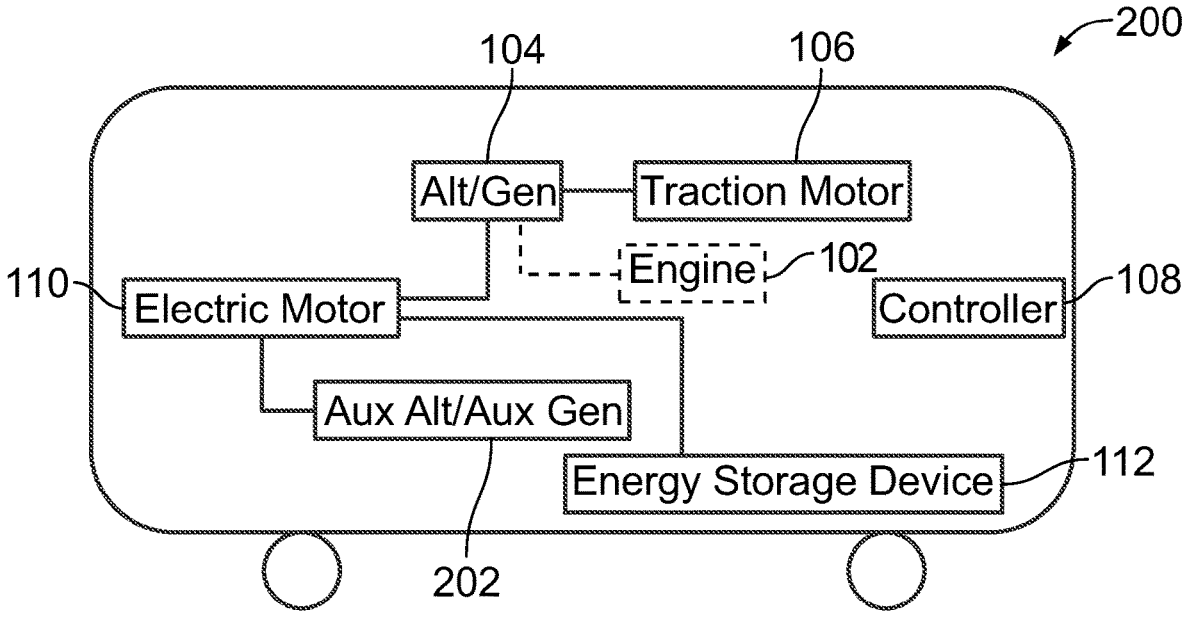
FIG. 2 illustrates a vehicle system in accordance with one embodiment.

FIG. 2 illustrates a vehicle system 200 in accordance with one or more embodiments of the subject matter described herein. Like the vehicle system illustrated in FIG. 1, the vehicle system 200 includes the engine operably coupled with the alternator and/or generator device. The engine may be removed from the vehicle system or disconnected from the traction motors, and the electric motor may be operably coupled with the alternator and/or generator device. For example, the engine may be removed, and the electric motor may replace or be a substitute for the engine. The electric motor may be conductively coupled with the energy storage device, which may provide electric energy to the electric motor.

The vehicle system 200 also includes one or more of an auxiliary alternator and/or auxiliary generator device 202 (illustrated as "Aux. Alt/Aux. Gen" in FIG. 2). The one or more of the auxiliary alternator and/or auxiliary generator device may be coupled with the electric motor via one or more belts or gears. The alternator and/or generator device 104 may be referred to as a first alternator or a first generator, or a propulsion alternator and/or propulsion generator, and the auxiliary alternator or auxiliary generator may be referred to as a second alternator or second generator, respectively. In one embodiment, the first alternator and/or generator device 104 may be used to power the one or more traction motors of the vehicle system, and the second or the auxiliary alternator and/or auxiliary generator may be used to power one or more non-propulsion loads of the vehicle system. In one or more embodiments, the auxiliary alternator and/or auxiliary generator may be used to power one or more non-propulsion loads on different vehicles of a multi-vehicle vehicle system.

Figure 3:
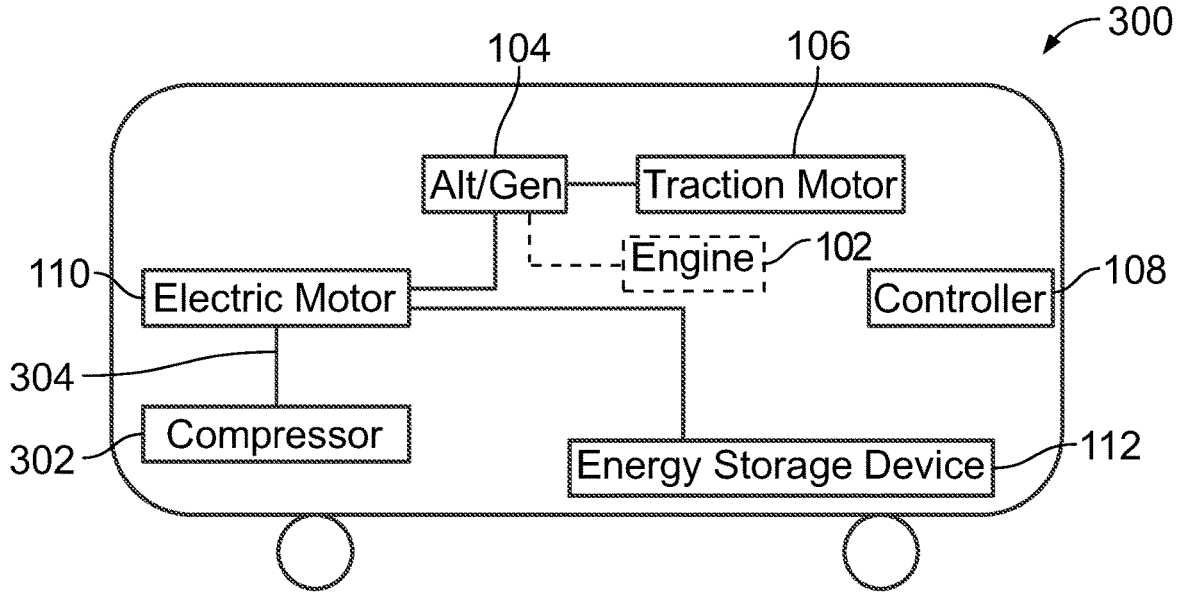
FIG. 3 illustrates a vehicle system in accordance with one embodiment.

FIG. 3 illustrates a vehicle system 300 in accordance with another embodiment. Like the vehicle systems 100 and 200, the vehicle system 300 includes the engine, the electric motor, the alternator and/or generator device, and the one or more traction motors. The engine may be removed from the vehicle system or disconnected from the traction motors, and the electric energy of the electric motor may be used to power the traction motors instead of the engine.

The vehicle system also includes a shaft 304 that is coupled with the electric motor at a first end of the shaft, and is coupled with a compressor 302, such as an air compressor of a brake system of the vehicle system, at another end of the shaft. Optionally, the compressor may be coupled with the electric motor by an alternative device, such as belts, gears, or other drive device. The electric motor may be used to rotate the shaft, and the compressor may be powered by the rotation of the shaft by the electric motor. The compressor may be used within or be a part of one or more fluid systems of the vehicle system. For example, the electric motor may provide power to the alternator and/or generator device to power the traction motors of the vehicle system, and may provide power to the air compressor to change or control one or more characteristics of a fluid moving within a non-propulsion system of the vehicle system.

In one or more embodiments, the controller may control operation of the electric motor such that power from the electric motor is directed to one or both of the alternator and/or generator device or the compressor. For example, the controller may control the electric motor to direct a first amount of electric energy to the alternator and/or generator device, and a second amount of electric energy to the compressor. Optionally, the controller may control the electric motor to direct electric energy to the alternator and/or generator device for a first predetermined amount of time or a predetermined amount of electric energy, and may subsequently control the electric motor to direct electric energy to the compressor for a second predetermined amount of time or a second predetermined amount of electric energy.

Figure 4:
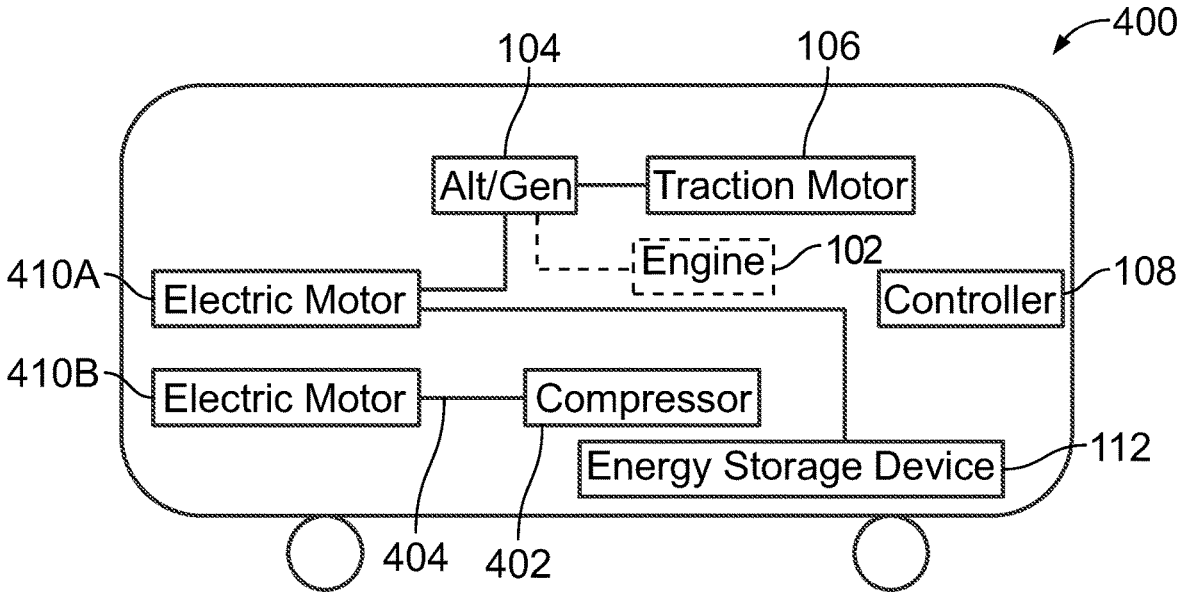
FIG. 4 illustrates a vehicle system in accordance with one embodiment.

FIG. 4 illustrates a vehicle system 400 in accordance with another embodiment. Like the vehicle systems 100 and 200, the vehicle system 300 includes the engine, the alternator and/or generator device, and the one or more traction motors. Optionally, the engine may be removed from the vehicle system and electric energy of a first electric motor 410A may be used to power the traction motors.

The vehicle system 400 includes a second electric motor 410B that is separate from the first electric motor. In the illustrated embodiment of FIG. 4, the first electric motor is operably coupled with the alternator and/or generator device, and the second electric motor is operably coupled with a compressor 402 via a shaft 404. For example, the first electric motor provides electric energy to power the traction motors via the alternator and/or generator device, and the second electric motor provides electric energy to power the compressor. The controller may control operation of each of the first and second electric motors. For example, the controller may control operations of the first electric motor, and may separately control operations of the second electric motor. Optionally, the controller may control operations of the first and second electric motors such that a shaft of the first electric motor rotates at a first speed, and a shaft of the second electric motor concurrently rotates at a second speed that is different than the first speed. For example, the first electric motor may rotate at the first speed at the same time or at a time that overlaps with rotation of the second electric motor at the different, second speed.

Figure 5:
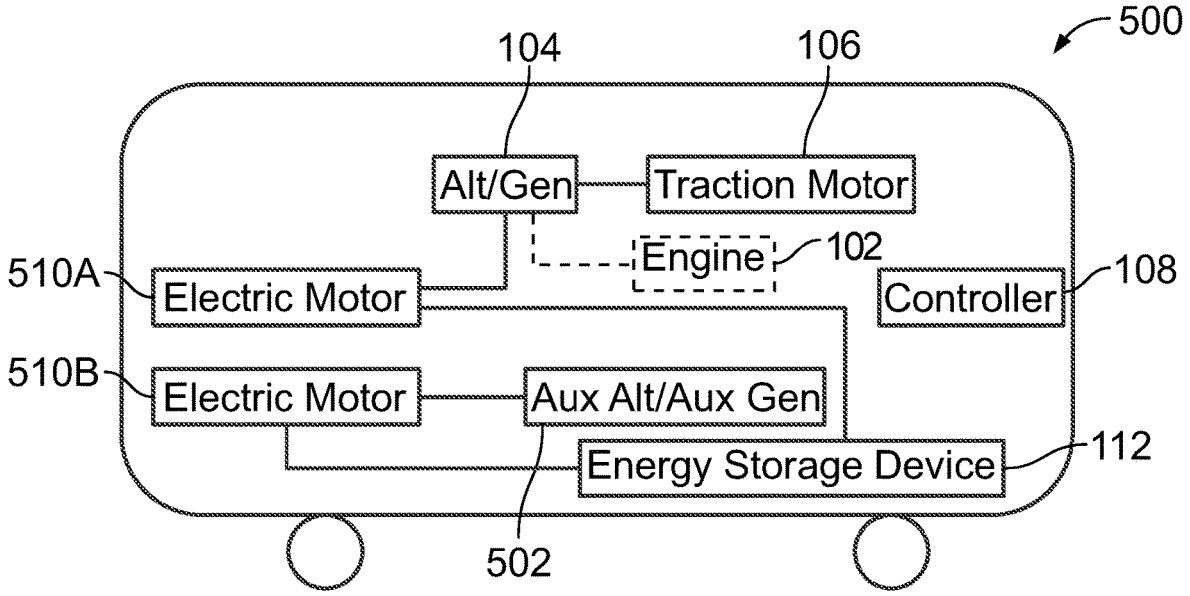
FIG. 5 illustrates a vehicle system in accordance with one embodiment.

Optionally, the second electric motor may be operably coupled with another device or system of the vehicle system. For example, FIG. 5 illustrates a vehicle system 500 in accordance with one embodiment. A first electric motor 510A provides electric energy to the alternator and/or generator device, and a second electric motor 510B is operably coupled with an provides electric energy to an auxiliary alternator and/or auxiliary generator. For example, the electric energy provided by the first electric motor may be used to propel the vehicle system via the traction motors, and the electric energy provided by the second electric motor may be used to one or more non-propulsion loads of the vehicle system. The controller may separately or independently control operation of the first and second electric motors. Optionally, the controller may control operation of one of the first or second electric motors based on the operation of the other of the first or second electric motors. For example, the controller may control operation of the first electric motor based on propulsion needs of the traction motors, and may control operation of the second electric motor based on an available amount of electric energy stored within the energy storage device.

Figure 6:
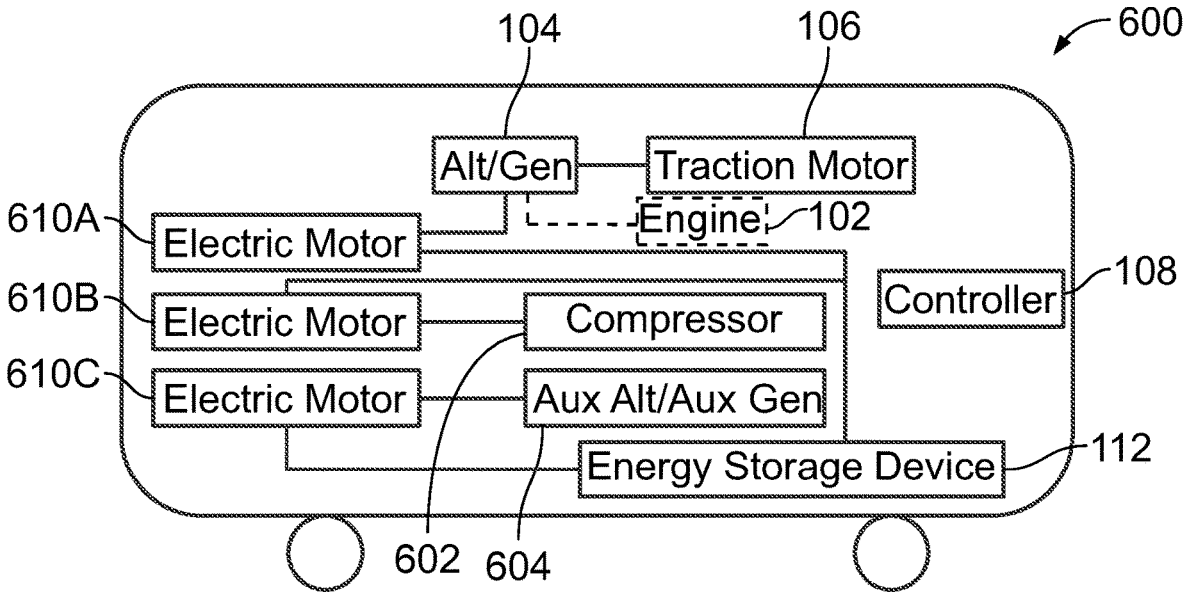
FIG. 6 illustrates a vehicle system in accordance with one embodiment.

FIG. 6 illustrates a vehicle system 600 in accordance with another embodiment. The vehicle system includes the engine that may provide power to the alternator and/or generator device. Optionally, the engine may be removed from the vehicle system, and a first electric motor 610A may be retrofitted onto the vehicle system to provide electric power to the alternator and/or generator device. For example, the alternator and/or generator device may generate electric energy from rotation created by the first electric motor to power the traction motors of the vehicle system to propel the vehicle system.

The vehicle system includes a second electric motor 610B that may be operably coupled with a compressor 602 (e.g., an air compressor). The vehicle system also includes a third electric motor 610C that may be operably coupled with one or more of an auxiliary alternator and/or auxiliary generator 604 to power one or more non-propulsion loads of the vehicle system. The energy storage device may be conductively coupled with each of the first, second, and third electric motors to provide stored electric energy to the electric motors.

In one or more embodiments, the controller may separately or independently control operation of each of the first, second, and third electric motors. For example, the controller may control operation of each of the first, second, and third electric motors based on needs of the vehicle system (e.g., propulsion load requirements, compressor load requirements, non-propulsion load requirements, or the like). Optionally, the controller may control operation of one of the electric motors based on an operating condition of another electric motor. Optionally, the controller may control operation of one or more electric motors based on an amount of available electric energy stored within the energy storage device. In one or more embodiments, the controller may control two or more electric motors to concurrently rotate at different speeds. Optionally, the controller may control two or more electric motors to concurrently rotate at the same or similar speeds (e.g., within a threshold percentage or range).

Figure 7:
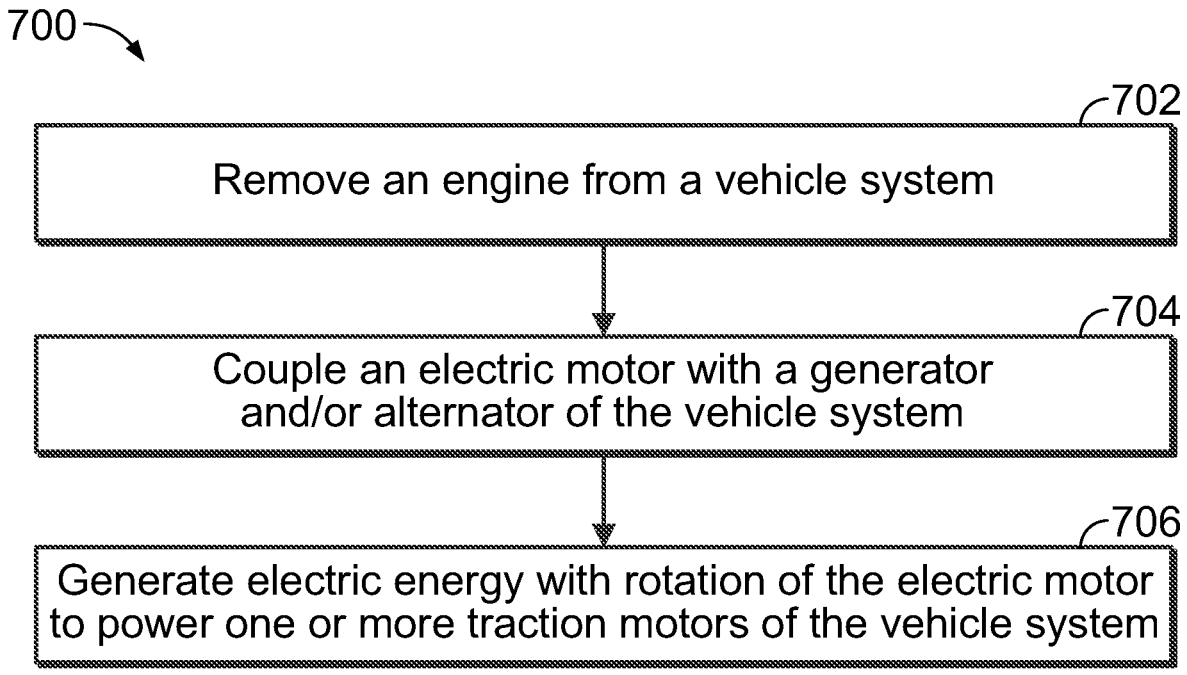
FIG. 7 illustrates a flowchart of one example of a method for controlling movement of a vehicle system.

FIG. 7 illustrates a flow chart 700 of one example of operating a vehicle system. The vehicle system may include an engine that may power one or more components and/or systems of the vehicle system. At 702, the engine may be removed from the vehicle system. Optionally, one or more engine related components (e.g., engine cooling system, engine exhaust system, fuel tank, or the like) may also be removed from the vehicle system. Optionally, the engine may remain onboard the vehicle system, but the engine may be selectively decoupled from one or more systems or components of the vehicle system. For example, the engine may remain onboard the vehicle, and may remain operably coupled with an one or more of an alternator and/or generator device, and a conductive conduit system may be disposed between the engine and the alternator and/or generator device to allow or prohibit power to move from the engine to the device.

At 704, an electric motor is disposed onboard the vehicle system and is coupled with the alternator and/or generator device. For example, the electric motor may provide electric energy to the alternator and/or generator based on a rotation of a shaft of the electric motor. In one or more embodiments, the engine may remain onboard the vehicle system, and the engine and the electric motor may separately provide energy to the alternator and/or generator device. For example, a controller may control operation of the engine to provide non-electric energy to the alternator and/or generator device based on a first operating requirement or first operating characteristic of the vehicle system, and the controller may control operation of the electric motor to provide electric energy to the alternator and/or generator device based on a second operating requirement or a second operating characteristic of the vehicle system (e.g., a velocity requirement of the vehicle system, an amount of cargo the vehicle system is carrying, the environment in which the vehicle system moves, or the like).

At 706, the alternator and/or generator device may use the electric energy supplied by the electric motor to generate electric energy to power one or more traction motors of the vehicle system to propel the vehicle system.

In one or more embodiments, the vehicle system may include an energy storage device that is conductively coupled with the electric motor. The energy storage device may store or contain electric energy that may be directed to the electric motor. For example, electric energy may be directed to the electric motor based on propulsion and/or non-propulsion load requirements of the vehicle system, based on an operating speed of the electric motor, or the like. In one or more embodiments, the energy storage device may be conductively coupled with an off-board power source to receive an amount of electric energy from the off-board power source, such as to refill or replenish an amount of electric energy that may be stored by the energy storage device. The energy storage device may be refilled, recharged, or the like, with electric energy from the off-board power source while the vehicle system is moving and/or while the vehicle system is stationary. Optionally, the energy storage device and/or the electric motor may be conductively coupled with a catenary line or electrified rail to provide electric power to the vehicle system.

In one or more embodiments of the subject matter described herein, a vehicle system includes an electric motor and one or more of a generator or an alternator coupled with the electric motor and configured to generate electric energy from rotation created by the electric motor. The generator or alternator is configured to power one or more traction motors to propel the vehicle system.

Optionally, the one or more of the generator or the alternator is one or more of a first generator or a first alternator. The vehicle system may include one or more of an auxiliary generator or an auxiliary alternator coupled with the electric motor by one or more belts or gears. The auxiliary generator and/or the auxiliary alternator may be configured to generate electric energy from rotation of the one or more belts or gears by the electric motor. The auxiliary generator and/or the auxiliary alternator may be configured to power one or more non-propulsion loads of the vehicle system.

Optionally, the electric motor may be coupled with a shaft and configured to rotate the shaft. An air compressor may be coupled with the shaft and configured to be powered by rotation of the shaft by the electric motor.

Optionally, the electric motor may be a first electric motor. The vehicle system may include a second electric motor and an air compressor coupled with the second electric motor. The air compressor may be powered by rotation of the second electric motor.

Optionally, the electric motor may be a first electric motor. The vehicle system may include a second electric motor and one or more of an auxiliary generator or an auxiliary alternator coupled with the second electric motor. The auxiliary generator and/or the auxiliary alternator may be configured to generate electric energy from rotation of the second electric motor.

Optionally, the electric motor may be a first electric motor. The vehicle system may include a second electric motor, a third electric motor, an air compressor coupled with the second electric motor by a shaft, and one or more of an auxiliary generator or an auxiliary alternator coupled with the third electric motor. The second electric motor may power the air compressor by rotating the shaft. The one or more of the auxiliary generator or auxiliary alternator may generate electric energy from rotation of the third electric motor. The auxiliary generator and/or the auxiliary alternator may power one or more non-propulsion loads of the vehicle system. A controller of the vehicle system may separately control operation of the first electric motor, the second electric motor, and the third electric motor with two or more of the first, second, or third electric motors concurrently rotating at different speeds.

Optionally, the vehicle system may include one or more energy storage devices configured to store electric energy and supply the electric energy to the electric motor and power the electric motor. One or more connectors may be conductively coupled with the one or more energy storage devices and configured to be coupled with an off-board power source for charging the one or more energy storage devices.

Optionally, a locomotive may include a vehicle system having an electric motor and one or more of a generator or an alternator coupled with the electric motor and configured to generate electric energy from rotation created by the electric motor. The generator and/or alternator may power one or more traction motors to propel the vehicle system. The electric motor may be a first electric motor. The locomotive may include one or more energy storage devices configured to store electric energy and supply the electric energy to the first electric motor and power the first electric motor. The locomotive may include one or more connectors conductively coupled with the energy storage devices and configured to be coupled with an off-board power source for charging the energy storage devices. The locomotive may include a second electric motor and a third electric motor. An air compressor may be coupled with the second electric motor and the second electric motor may power the air compressor. One or more of an auxiliary generator or an auxiliary alternator may be coupled with the third electric motor. The auxiliary generator and/or auxiliary alternator may generate electric energy from rotation of the third electric motor. The auxiliary generator and/or the auxiliary alternator may power one or more non-propulsion loads of the vehicle system. A controlled may separately control operation of the first, second, and third electric motors with two or more of the first, second, or third electric motors concurrently rotating at different speeds.

In one or more embodiments of the subject matter described herein, a method includes removing an engine from a vehicle system that is coupled with one or more of a generator or an alternator for powering one or more traction motors to propel the vehicle system. An electric motor is coupled with the one or more of the generator or the alternator to generate electric energy and power the one or more traction motors to propel the vehicle system.

Optionally, the one or more of the generator or the alternator may be one or more of a first generator or a first alternator. The method may include coupling one or more of an auxiliary generator or an auxiliary alternator with the electric motor. The auxiliary generator and/or the auxiliary alternator may generate electric energy from rotation of one or more belts or gears by the electric motor. The auxiliary generator and/or the auxiliary alternator may power one or more non-propulsion loads of the vehicle system.

Optionally, an air compressor may be coupled with the electric motor by a shaft.

Optionally, the electric motor may be a first electric motor. The method may include coupling a second electric motor with an air compressor configured to be powered by rotation of the second electric motor.

Optionally, the electric motor may be a first electric motor. The method may include coupling a second electric motor with one or more of an auxiliary generator or an auxiliary alternator. The one or more of the auxiliary generator or the auxiliary alternator may generate electric energy from rotation of the second electric motor.

Optionally, the electric motor may be a first electric motor. The method may include coupling a second electric motor with an air compressor by a shaft, and coupling a third electric motor with one or more of an auxiliary generator or an auxiliary alternator. The second electric motor may power the air compressor by rotating the shaft. The one or more of the auxiliary generator or the auxiliary alternator may generate electric energy from rotation of the third electric motor. The auxiliary generator and/or the auxiliary alternator may power one or more non-propulsion loads of the vehicle system. Operations of the first electric motor, the second electric motor, and the third electric motor may be separately controlled with two or more of the first electric motor, the second electric motor, or the third electric motor concurrently rotating at different speeds.

Optionally, the method may include removing an engine cooling system from the vehicle system.

In one or more embodiments of the subject matter described herein, a vehicle system includes an electric motor, one or more of a propulsion generator or a propulsion alternator coupled with the electric motor and configured to generate first electric energy from rotation of the electric motor. The one or more of the propulsion generator or the propulsion alternator is configured to power one or more traction motors. The vehicle system includes one or more an auxiliary generator or an auxiliary alternator coupled with the electric motor and configured to generate second electric energy from rotation of the electric motor to power one or more auxiliary loads of the vehicle system.

Optionally, the electric motor may be coupled with a shaft and is configured to rotate the shaft. An air compressor coupled with the shaft may be powered by rotation of the shaft by the electric motor.

Optionally, the electric motor may be a first electric motor. The vehicle system may include a second electric motor and an air compressor coupled with the second electric motor. The air compressor may be powered by rotation of the second electric motor.

Optionally, the vehicle system may include a controller for separately controlling operation of the first electric motor and the second electric motor.

Optionally, the controller may control the first electric motor to rotate at a different speed than the second electric motor at the same time.

Optionally, the vehicle system may include one or more energy storage devices configured to store electric energy and supply the electric energy to the electric motor and power the electric motor. The vehicle system may include one or more connectors conductively coupled with the one or more energy storage devices and configured to be coupled with an off-board power source for charging the one or more energy storage devices.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and clauses, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and clauses, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The clauses define the patentable scope of the disclosure, and include other examples that occur to those of ordinary skill in the art. Such other examples are intended to be within the scope of the clauses if they have structural elements that do not differ from the literal language of the clauses, or if they include equivalent structural elements with insubstantial differences from the literal language of the clauses.

What is claimed is:

1. A vehicle system comprising:

an electric motor; and one or more of a generator or an alternator coupled with the electric motor and configured to generate electric energy from rotation created by the electric motor, the one or more of the generator or the alternator configured to power one or more traction motors to propel the vehicle system.

2. The vehicle system of claim 1, wherein the one or more of the generator or the alternator is one or more of a first generator or a first alternator, and further comprising:

one or more of an auxiliary generator or an auxiliary alternator coupled with the electric motor by one or more belts or gears, the one or more of the auxiliary generator or the auxiliary alternator configured to generate electric energy from rotation of the one or more belts or gears by the electric motor, the one or more of the auxiliary generator or the auxiliary alternator configured to power one or more non-propulsion loads of the vehicle system.

3. The vehicle system of claim 1, wherein the electric motor is coupled with a shaft and is configured to rotate the shaft, and further comprising:

an air compressor coupled with the shaft and configured to be powered by rotation of the shaft by the electric motor.

4. The vehicle system of claim 1, wherein the electric motor is a first electric motor, and further comprising:

a second electric motor; and an air compressor coupled with the second electric motor, the air compressor configured to be powered by rotation of the second electric motor.

5. The vehicle system of claim 1, wherein the electric motor is a first electric motor, and further comprising:

a second electric motor; and one or more of an auxiliary generator or an auxiliary alternator coupled with the second electric motor, the one or more of the auxiliary generator or the auxiliary alternator configured to generate electric energy from rotation of the second electric motor.

6. The vehicle system of claim 1, wherein the electric motor is a first electric motor, and further comprising:

a second electric motor;

a third electric motor;

an air compressor coupled with the second electric motor by a shaft, the second electric motor configured to power the air compressor by rotating the shaft;

one or more of an auxiliary generator or an auxiliary alternator coupled with the third electric motor, the one or more of the auxiliary generator or the auxiliary alternator configured to generate electric energy from rotation of the third electric motor, the one or more of the auxiliary generator or the auxiliary alternator configured to power one or more non-propulsion loads of the vehicle system; and a controller configured to separately control operation of the first electric motor, the second electric motor, and the third electric motor with two or more of the first electric motor, the second electric motor, or the third electric motor concurrently rotating at different speeds.

7. The vehicle system of claim 1, further comprising:

one or more energy storage devices configured to store electric energy and supply the electric energy to the electric motor and power the electric motor; and one or more connectors conductively coupled with the one or more energy storage devices and configured to be coupled with an off-board power source for charging the one or more energy storage devices.

8. A locomotive comprising:

the vehicle system of claim 1, wherein the electric motor is a first electric motor;

one or more energy storage devices configured to store electric energy and supply the electric energy to the first electric motor and power the first electric motor;

one or more connectors conductively coupled with the one or more energy storage devices and configured to be coupled with an off-board power source for charging the one or more energy storage devices;

a second electric motor and a third electric motor;

an air compressor coupled with the second electric motor, the second electric motor configured to power the air compressor;

one or more of an auxiliary generator or an auxiliary alternator coupled with the third electric motor, the one or more of the auxiliary generator or the auxiliary alternator configured to generate electric energy from rotation of the third electric motor, the one or more of the auxiliary generator or the auxiliary alternator configured to power one or more non-propulsion loads of the vehicle system; and a controller configured to separately control operation of the first electric motor, the second electric motor, and the third electric motor with two or more of the first electric motor, the second electric motor, or the third electric motor concurrently rotating at different speeds.

9. A method comprising:

removing an engine from a vehicle system that is coupled with one or more of a generator or an alternator for powering one or more traction motors to propel the vehicle system; and coupling an electric motor with the one or more of the generator or the alternator such that rotation of the electric motor powers the one or more of the generator or the alternator to generate electric energy and power the one or more traction motors to propel the vehicle system.

10. The method of claim 9, wherein the one or more of the generator or the alternator is one or more of a first generator or a first alternator, and further comprising:

coupling one or more of an auxiliary generator or an auxiliary alternator with the electric motor, the one or more of the auxiliary generator or the auxiliary alternator configured to generate electric energy from rotation of one or more belts or gears by the electric motor, the one or more of the auxiliary generator or the auxiliary alternator configured to power one or more non-propulsion loads of the vehicle system.

11. The method of claim 9, further comprising:

coupling an air compressor with the electric motor by a shaft.

12. The method of claim 9, wherein the electric motor is a first electric motor, and further comprising:

coupling a second electric motor with an air compressor, the air compressor configured to be powered by rotation of the second electric motor.

13. The method of claim 9, wherein the electric motor is a first electric motor, and further comprising:

coupling a second electric motor with one or more of an auxiliary generator or an auxiliary alternator, the one or more of the auxiliary generator or the auxiliary alternator configured to generate electric energy from rotation of the second electric motor.

14. The method of claim 9, wherein the electric motor is a first electric motor, and further comprising:

coupling a second electric motor with an air compressor by a shaft, the second electric motor configured to power the air compressor by rotating the shaft;

coupling a third electric motor with or more of an auxiliary generator or an auxiliary alternator, the one or more of the auxiliary generator or the auxiliary alternator configured to generate electric energy from rotation of the third electric motor, the one or more of the auxiliary generator or the auxiliary alternator configured to power one or more non-propulsion loads of the vehicle system; and separately controlling operation of the first electric motor, the second electric motor, and the third electric motor with two or more of the first electric motor, the second electric motor, or the third electric motor concurrently rotating at different speeds.

15. The method of claim 9, further comprising:

removing an engine cooling system from the vehicle system.

16. A vehicle system comprising:

an electric motor;

one or more of a propulsion generator or a propulsion alternator coupled with the electric motor and configured to generate first electric energy from rotation of the electric motor, the one or more of the propulsion generator or the propulsion alternator configured to power one or more traction motors; and one or more of an auxiliary generator or an auxiliary alternator coupled with the electric motor and configured to generate second electric energy from rotation of the electric motor to power one or more auxiliary loads of the vehicle system.

17. The vehicle system of claim 16, wherein the electric motor is coupled with a shaft and is configured to rotate the shaft, and further comprising:

an air compressor coupled with the shaft and configured to be powered by rotation of the shaft by the electric motor.

18. The vehicle system of claim 16, wherein the electric motor is a first electric motor, and further comprising:

a second electric motor; and an air compressor coupled with the second electric motor, the air compressor configured to be powered by rotation of the second electric motor.

19. The vehicle system of claim 18, further comprising:

a controller configured to separately control operation of the first electric motor and the second electric motor.

20. The vehicle system of claim 19, wherein the controller is configured to control the first electric motor to rotate at a different speed than the second electric motor at the same time.

21. The vehicle system of claim 16, further comprising:

one or more energy storage devices configured to store electric energy and supply the electric energy to the electric motor and power the electric motor; and one or more connectors conductively coupled with the one or more energy storage devices and configured to be coupled with an off-board power source for charging the one or more energy storage devices.

* * * * *